US005332214A

United States Patent [19]

Tucker, Sr.

[11] Patent Number: 5,332,214

[45] Date of Patent: Jul. 26, 1994

[54] GOLF PUTTER

[75] Inventor: Richard B. C. Tucker, Sr., Baltimore, Md.

[73] Assignee: STX, Inc., Baltimore, Md.

[21] Appl. No.: 107,590

[22] Filed: Aug. 18, 1993

[51] Int. Cl.[5] ..... A63B 53/04

[52] U.S. Cl. ..... 273/78; 273/171

[58] Field of Search ..... 273/78, 167 J, 173, 273/174, 171, 168, 167 F, 167 H

[56] References Cited

U.S. PATENT DOCUMENTS 3,220,733 11/1965 Saleeby ..... 273/171

4,121,832 10/1978 Ebbing ..... 273/171

4,422,638 12/1983 Tucker ..... 273/78

4,792,140 12/1988 Yamaguchi et al. ..... 273/78 X 4,804,188 2/1989 McKee et al. ..... 273/78 X

*Primary Examiner*—George J. Marlo

*Attorney, Agent, or Firm*—Breiner & Breiner

[57] ABSTRACT

A golf putter (15) wherein an elastomeric striking face (9) is secured to support member (11) which is secured by fasteners (21, 23, 30, 31) in a recessed area (24) of a putter head body member (19) containing a through cavity (25) in which weight (13) is seated rearward of the support member (11).

7 Claims, 1 Drawing Sheet 13
21
9
11
19

17
15
23
21
27
25
29
13
31
16
19
24
11
30
9

13
9
12
11

5
13
30
STX
31
11
5

3
13
21
STX
16
23
3

GOLF PUTTER

FIELD OF THE INVENTION

This invention relates to golf putters. More particularly, the invention relates to a golf putter having a multi-component head including a changeable striking face and weights which permit the golfer to readily tailor the weight, touch, feel, and control of the putter to the particular golfer's needs and style, including adapting the putter to changing green conditions.

BACKGROUND OF THE INVENTION

It is recognized by a golfer that on the putting green, accurate propulsion of the ball to and into the hole requires a sense of touch and feel. The desire of the golfer to maximize the touch and feel necessary to control accurately the direction of the ball movement and the distance of the ball movement on the putting green has led to literally hundreds of putter shapes and designs. The various shapes and designs have included putters having heads with an increased mass to increase the distance of ball travel with a short backswing; localization and balancing of the mass in the putter head to improve directional accuracy; decreased mass in the putter head to provide increased accuracy, and the use of a striking face made of rubber or plastic material to impart a sense of feel and touch while controlling the rebound characteristics of the ball when struck with the rubber or plastic face of the putter.

The various putter designs and striking faces of different shapes and weights have experienced a mixed degree of success. However, U.S. Pat. No. 4,422,638 discloses a golf putter having a soft elastomeric face, with the elastomer having a hardness of at least 70 Durometer A and a hardness below the hardness of a golf ball. Additionally, the elastomer has a resiliency sufficient to cause a golf ball, after penetrating into the elastomeric face, to rebound a distance equal to or greater than the distance that a golf ball will rebound when stroked with an equivalent force with a metal face putter. This putter, because of the soft face with its unique characteristics, provides excellent touch and feel, contributing to greater control of direction and distance of a stroked golf ball. The putter of the present invention is a further improvement over the putters of the '638 patent.

SUMMARY OF THE INVENTION

The present invention provides a golf putter having a changeable elastomeric face as defined in the aforesaid '638 patent to permit variation in the touch, feel, and rebound characteristics of the putter; and, additionally, permits the weight of the putter head to be varied by changing the thickness of the support surface for the elastomeric face and/or by attaching a weighted member to the support surface that is designed to receive it. The changeable elastomeric face, the changeable support for the elastomeric face, and weights can be, in multiple combinations, mated to each other so that they can be rapidly changed on the putter by connecting means, such as screw members exposed at the rear of the putter head. The connecting means is constructed and arranged in a manner which does not distract from the vision of the golfer when putting or distract from the beauty of the putter design. The construction of the components of the putter, being matched or mated to each other, permits the use of weights of varying mass, or the elimination of the weight, without noticeable change in the putter except for its weight. Accordingly, the putter can be tailored to the specific characteristics of weight, touch, feel, and control of the individual golfer, with these characteristics being readily adjusted by the individual golfer from one round of golf to the next.

THE DRAWING AND PRESENTLY PREFERRED EMBODIMENT

Having described the invention in general terms, a specific and preferred embodiment will be described in detail in reference to the illustrative drawing wherein, FIG. 1 is a putter of the present invention illustrating an exploded perspective view of the putter head with the putter shaft partly broken-away;

Figures 1, 2, 3, 4, 5:
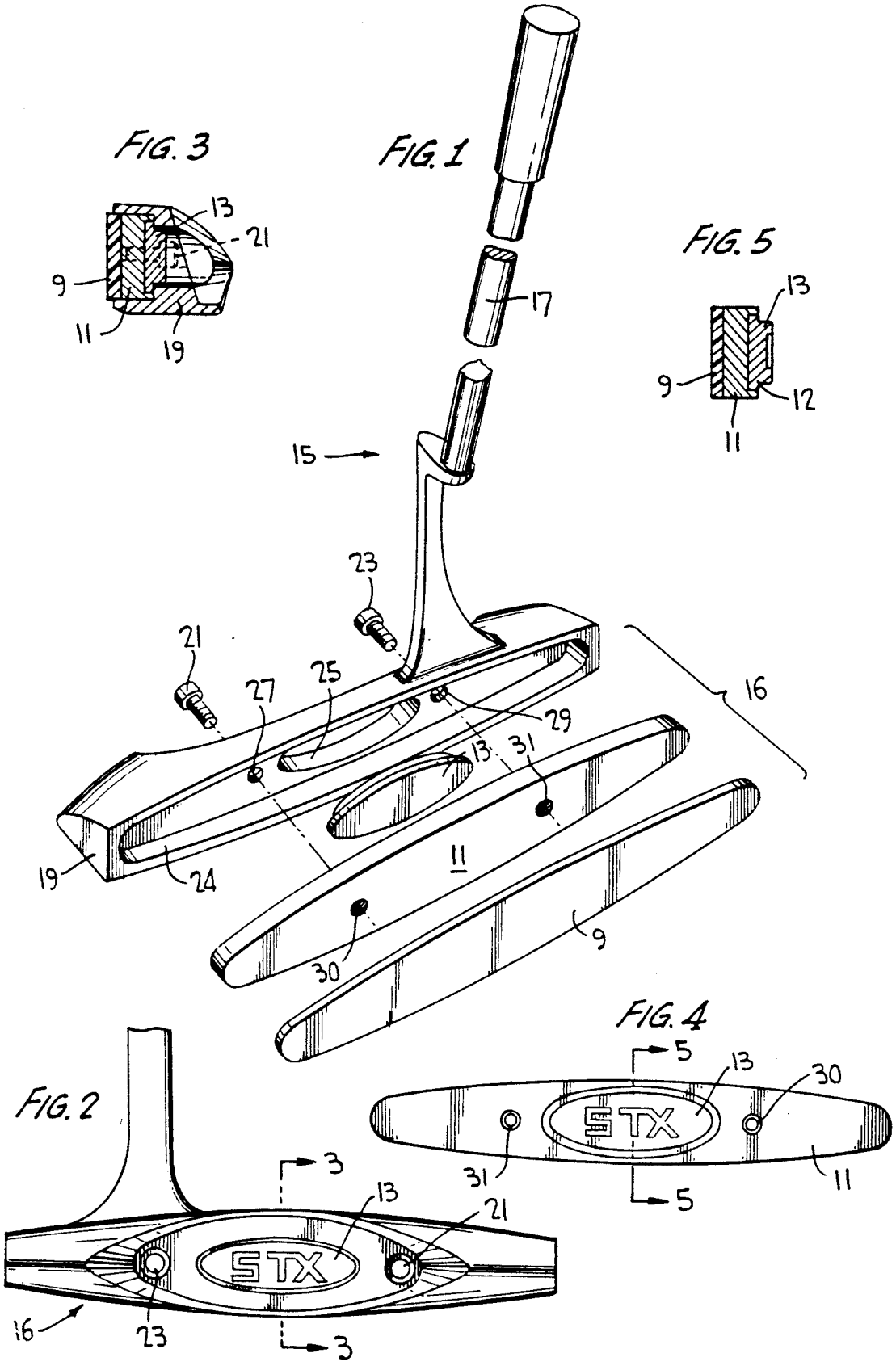
FIG. 2 is a rear view of the assembled putter head.
FIG. 3 is a sectional view along line 3—3 of FIG. 2.
FIG. 4 is a rear view of assembled elastomer, support member for the elastomer, and weight.
FIG. 5 is a sectional view along line 5—5 of FIG. 4.

Reference is first made to FIG. 1 which illustrates a putter generally identified by the number 15 which includes multi-component head 16 in exploded view and a shaft 17 extending upward from the head 16. Head 16 includes, in order, an elastomeric striking face 9, a support member 11 for said elastomeric face 9, a weight 13, a body member 19, and connecting members 21 and 23. As shown in FIG. 1, body member 19 includes a recessed area 24 extending substantially across the front of the body member and a central cavity 25 extending through the body member for receiving weight 13, and holes 27 and 29 for receiving connecting members 21 and 23. Support member 11 includes holes 30 and 31 also for receiving connecting members 21 and 23 when it is fitted into recessed area 24. Elastomeric face 9 is adhesively secured to the support member 11.

As shown in FIG. 2, when the multi-components of the head are assembled, the putter from the rear has a clean view, with weight 13 being seen from the rear of the putter. FIG. 3, which is a sectional view along line 3—3 of FIG. 2, shows the relationship of the components of the putter head. Thus, the elastomeric face 9 secured to support member 11 extends slightly beyond the front of body member 19 when support member 11 is fitted into recessed area 24. A lip 12 on weight 13 extends into a recessed area in support member 11. Accordingly, when the weight member is in place, it will extend into central cavity 25 of putter body member 19, but will not pass through. It will be held in place in cavity 25 by support member 11 when connecting members 21 and 23 are in place.

FIG. 4 is a rear view of support member 11, elastomeric face 9, and weight 13 in place. As shown in each of FIGS. 2 and 4, weight 13 can suitably have indicia such as a trademark "STX" or the like inscribed thereon. FIG. 5 shows the relationship of weight 13 having lip 12 fitted into the indentation or recess of support member 11. As will be apparent, if the weight is not utilized, support member 11 will still be secured to body member 12 in the same way by connecting members 21 and 23, and the appearance of the putter will be substantially identical with or without the weight. The only difference will be in the weight mass of the putter.

Accordingly, the structure of the putter described according to the present invention provides an improved putter which can be tailored to meet the needs of any particular golfer or to respond to the variable conditions of putting greens.

In practicing the present invention, the elastomeric striking face can be any of the elastomers defined in U.S. Pat. No. 4,422,638 assigned to the assignee of the present application, with the disclosure of the aforesaid '638 patent incorporated herein by reference. Preferably the elastomeric face will have the controlled properties defined in the '638 patent. However, according to the present invention, since the striking face of the putter is readily changed, the elastomeric face can be suitably chosen to meet the playing characteristics desired by the individual golfer, with those characteristics being changed simply by selecting an elastomer having different touch, feel, and rebound characteristics.

As will be apparent to one skilled in the art, various polymers, including polymers having different chemical formulations, can be fabricated to meet the hardness and rebound characteristics essential to provide an elastomeric face in accordance with the present invention. The essential characteristic is that the elastomer be chemically formulated to produce the unique rebound response which permits penetration of the elastomer by a golf ball when stroked and a sharp rebound response. Polyester elastomers marketed by DuPont under the tradename HYTREL are presently preferred materials. HYTREL 8122 provides a fast or high rebound, whereas HYTREL 4069 provides a slow or low rebound, and are illustrative of such elastomers. Moreover, the thickness of the elastomeric face can vary. Although it has been found that a thickness of three-sixteenths (3/16") inch is acceptable, the thickness can be increased or decreased with acceptable performance of the putter. "Elastomer" as used herein is intended to designate any synthetic plastic material which provides the unique rebound characteristics useful in a putter face.

As will be further apparent to one skilled in the art, the weight of the putter can be readily modified by a number of different means, including having the support member for the elastomeric face made of a metal of varying density or varying thickness, and by using weights, or eliminating the weights. The mass of the weights can be adjusted, again by judicious selection of the metals utilized and the dimensioning of the metals. The metals can be aluminum alloys or brass, or any material which provides the characteristics desired. The weights preferably will be from about 5–40 grams.

The characteristics of the putter can also be modified by judicious selection of the material for body member 19. Thus, preferably the body member and the support member are of metal such as brass, but again can be of a different metal, or plastic, to provide varying characteristics in the putter.

As will be apparent to one skilled in the art, various modifications can be made within the scope of the aforesaid description. Such modifications, being within the ability of one skilled in the art, form a part of the present invention and are embraced by the appended claims.

It is claimed:

1. A putter having a shaft and a multi-component head secured to said shaft, said multi-component head comprising a body member, a weight, an elastomeric face member, a support member for said face member, and connecting members for changeably securing said head components in operable association, said body member having a recessed area substantially co-extensive with the front of the body for receiving said support member; a central cavity extending through said body member for receiving said weight, and hole means for passing said connecting members through said body member; said support member having a front and rear surface constructed and arranged to be changeably secured in said recessed area of said body member and including a central recessed area at its rear surface for positioning said weight, and means for receiving said connecting members which are passed through said body member; said weight being mated to the recess in said support member and to the central cavity of said body member; and said elastomeric member secured to the front surface of said support member; said body member, weight, and support member being held in place by said connecting means.

2. The putter of claim 1 wherein the elastomeric member has a hardness of at least 70 Durometer A.

3. The putter of claim 1 wherein the elastomeric member has a hardness of at least 70 and below 100 Durometer A, and a resiliency of greater than 60% (Bashore).

4. The putter of claim 1 wherein the elastomeric member is a urethane polymer.

5. The putter of claim 1 wherein the elastomeric member is a polyester polymer.

6. The putter of claim 5 wherein the polyester is HYTREL 8122 or HYTREL 4069.

7. The putter of claim 1 wherein the connecting members are screws with a hexagon slot for engagement with a tool.

* * * * *